US006564570B2

(12) United States Patent
Koike et al.

(10) Patent No.: US 6,564,570 B2
(45) Date of Patent: May 20, 2003

(54) HORIZONTAL REFRIGERATOR

(75) Inventors: Yasuhide Koike, Ohara-gun (JP); Toshinobu Ishihara, Nita-gun (JP); Tomio Suyama, Ohara-gun (JP); Kouichi Yamamoto, Hikawa-gun (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 0 days.

(21) Appl. No.: 10/005,420

(22) Filed: Dec. 4, 2001

(65) Prior Publication Data

US 2002/0083727 A1 Jul. 4, 2002

(30) Foreign Application Priority Data

Dec. 4, 2000 (JP) ..... 2000-368949

(51) Int. Cl.[7] ..... F25D 23/12
(52) U.S. Cl. ..... 62/258
(58) Field of Search ..... 62/258

(56) References Cited

U.S. PATENT DOCUMENTS 2,443,787 A * 6/1948 Earle ..... 62/258
2,490,494 A * 12/1949 Widman ..... 62/258
2,886,395 A * 5/1959 Cahn ..... 62/258
3,161,030 A * 12/1964 Brewton ..... 62/378
4,320,631 A * 3/1982 Vana ..... 62/256
4,545,211 A * 10/1985 Gaus ..... 62/258
4,741,172 A * 5/1988 Aoki ..... 62/248
5,168,719 A * 12/1992 Branz et al. ..... 62/258
5,367,887 A * 11/1994 Byrd et al. ..... 62/258
5,477,702 A * 12/1995 Kennedy et al. ..... 62/258
5,722,254 A * 3/1998 Roth et al. ..... 62/451
6,257,010 B1 * 7/2001 Shei et al. ..... 62/258

* cited by examiner

*Primary Examiner*—William E. Tapolcai
*Assistant Examiner*—Mohammad M. Ali
(74) *Attorney, Agent, or Firm*—Koda & Androlia

(57) ABSTRACT

The cooling efficiency of a refrigerating chamber and a storage chamber is improved, and the cooling capability is prevented from degrading.

A horizontal refrigerator 10 is comprised of an underlying refrigerator body 11 and an overlying show-case 12. The show-case 12 disposed on the top surface of a thermally insulated box 16 of the refrigerator body 11 is comprised of an outer box 37, an inner box 38 disposed within the outer box 37 spaced by a necessary space therefrom, and a heat insulating material 39 filled between both boxes 37, 38, and an opening 12*a* is formed only in a top portion. The opening 12*a* is opened and closed by a plurality of slidable doors 45. A cooling pipe 47 connected to a refrigerating mechanism is disposed in a meander form in contact with the outer surface on the insulating material side in the bottom and rear portions of the inner box 38, such that the entire inner box 38 is cooled by circulation of a coolant supplied from the refrigerating mechanism.

2 Claims, 4 Drawing Sheets

HORIZONTAL REFRIGERATOR

FIELD OF THE INVENTION

This invention relates to a horizontal refrigerator which has a showcase installed on the top surface of a thermally insulated box.

DESCRIPTION OF THE RELATED ART

As a horizontal refrigerator for use in a kitchen of a restaurant and the like, which has a show-case installed thereon for refrigerating food materials such as food materials for sushi, vegetables and the like, one described, for example, in Japanese Unexamined Patent Publication No. Hei 11-294925 exists. The horizontal refrigerator described in this publication document has a refrigerating chamber defined within a thermally insulated box, which constitutes the body of the refrigerator such that cold air cooled by a cooler constituting a refrigerating mechanism together with a compressor and a condenser is supplied in the refrigerating chamber by a built-in fan to cool down the refrigerating chamber. On the bottom of a show-case having a thermally insulated structure, installed on the top surface of the thermally insulated box, an opening is formed at a position corresponding to an opening formed through a ceiling of the thermally insulated box, such that cold air within the refrigerating chamber is introduced into a storage chamber defined in the show-case through both openings to cool the storage chamber. The show-case is formed with an output port from an upper portion to a front portion, and the output port is constructed to be opened and closed by a slidable door.

With the foregoing horizontal refrigerator, a large number of preliminarily prepared food materials and the like are contained in the storage chamber of the show-case, and taken out from the storage chamber, when cooked, and cooked on the top surface of the thermally insulated box in front of the show-case. In this event, since the refrigerator employs a cooling method which forcedly circulates cold air by convection into the refrigerating chamber and storage chamber using the built-in fan, a problem is pointed out that food materials and the like contained in the storage chamber is dried by a flow of cold air and are likely to lose its freshness. Accordingly, there has been proposed a method which involves providing a show-case with a thermally conductive panel which is cooled by cold air introduced from a refrigerator, and cooling down a storage chamber by natural convection of the cold air cooled by the thermally conductive panel. While the natural convection based cooling method prevents food materials and the like within the storage chamber from drying, the thermally conductive panel cannot be disposed at an output port formed through the show-case, resulting in a problem of a limited area cooled down by the panel, and a low cooling efficiency.

Also, since the refrigerating chamber is in communication with the storage chamber through the openings, moisture in the air in both chambers clings to the cooler for cooling both chambers as frost. Moreover, since a large amount of warm air including moisture flows into the refrigerating chamber from the storage chamber of the show-case which is often opened and closed by the slidable door, a large amount of frost clings to the cooler in a short time, causing a problem of insufficient cooling by the cooler and low cooling capability. Further, a problem is also pointed out that since the output port of the show-case is formed from an upper portion to a front portion, cold air near the bottom flows out when the slidable door is left open, and warm air flows into the storage chamber and refrigerating chamber, temperature in both chambers is likely to rise.

The horizontal refrigerator described above is constructed to close the opening formed through the ceiling of the thermally insulated box with a lid such that the show-case can be removed from the thermally insulated box to use only the refrigerator section (only the thermally insulated box). However, the heat insulating performance is low at the opening closed by the lid, causing a problem of low cooling capability as compared with a product which is not provided with an opening through the top of a thermally insulated box. Also, a portion around the opening closed by the lid has a lower strength as compared with a product which is not provided with an opening on the top of a thermally insulated box, resulting a tendency for deformation of the top surface of the box, a dent of the lid and its surroundings, and the like, and resulting inconvenience in cooking on the thermally insulated box.

Food materials and the like within the show-case are cooled generally within service hours, and not out of the service hours. However, with the conventional horizontal refrigerator, even when the show-case is not used, cold air in the refrigerating chamber flows out from the opening of the thermally insulated box to the storage chamber, causing a problem, as pointed out, that a cooling efficiency lowers in the refrigerating chamber, a larger load resulting therefrom is applied to the compressor, and larger electric power is consumed to increase running costs. In the structure in which the opening can be closed by the lid in the foregoing manner, cold air can be prevented to some degree from flowing out from the refrigerating chamber into the storage chamber. However, it is difficult to completely eliminate outflow of cold air through a gap between the lid and the thermally insulated box. Even if the lid is made in a thermally insulated structure, thickness of the heat insulating material is less than thickness of a heat insulating material of the thermally insulated box to cause heat exchange to the storage chamber, thereby failing to prevent an increase in running costs due to a larger load on the compressor.

SUMMARY OF THE INVENTION

The present invention has been proposed in view of the disadvantages mentioned above to preferably solve them, and it is an object of the invention to provide a horizontal refrigerator which is capable of preventing lower cooling capability, and also capable of preventing a lower cooling efficiency for a refrigerating chamber when a show-case is not in use.

To overcome the problem and preferably achieve the intended object, the present invention is characterized by being a horizontal refrigerator for cooling a refrigerating chamber defined inside a thermally insulated box by a cooler of a cooling mechanism, and having a show-case disposed on a top surface of the heat insulating box, wherein:

the show-case comprises an outer box, an inner box disposed within the outer box spaced by a necessary space therefrom and a heat insulating material filled between both boxes, an opening is formed only in a top portion thereof, and a cooling pipe connected to said cooling mechanism is disposed in contact with an outer surface, where said heat insulating material is filled, of said inner box, such that a storage chamber defined inside said show-case is cooled by said cooling pipe.

DETAILED DESCRIPTION OF THE PREFERRED EMBODIMENT

Figure 1:
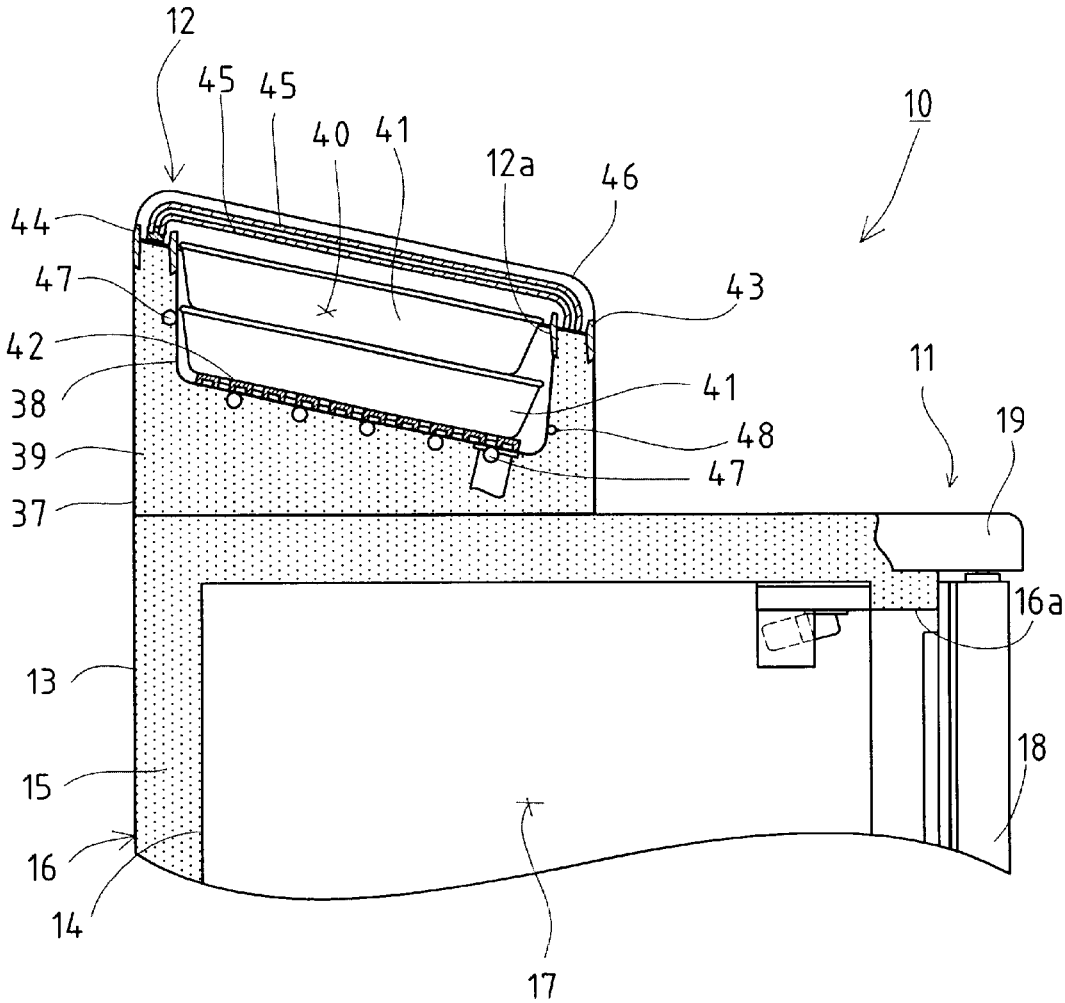
FIG. 1 is a vertical side sectional view of a main portion of a horizontal refrigerator according to a preferred embodiment of the present invention.
Figure 2:
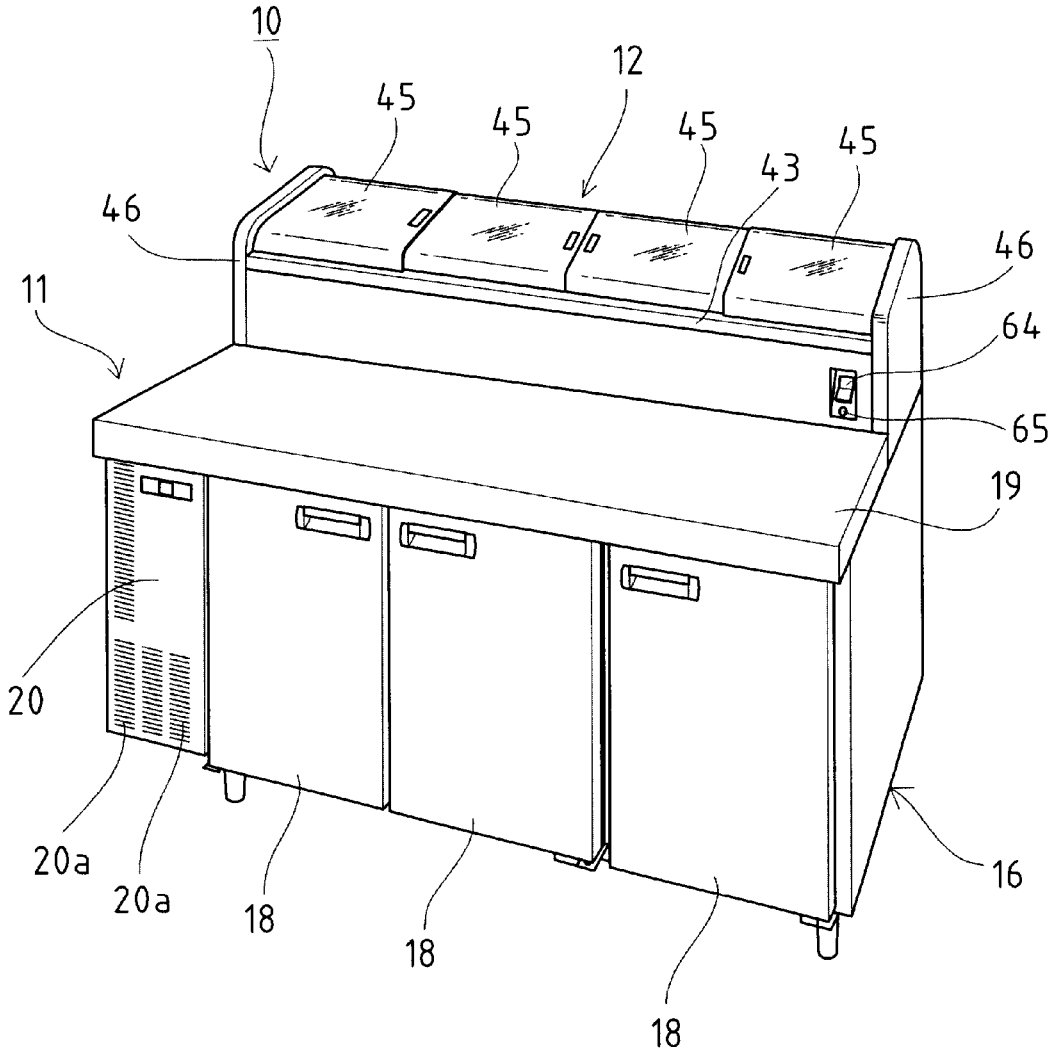
FIG. 2 is a general perspective view of the horizontal refrigerator according to the embodiment.
Figure 3:
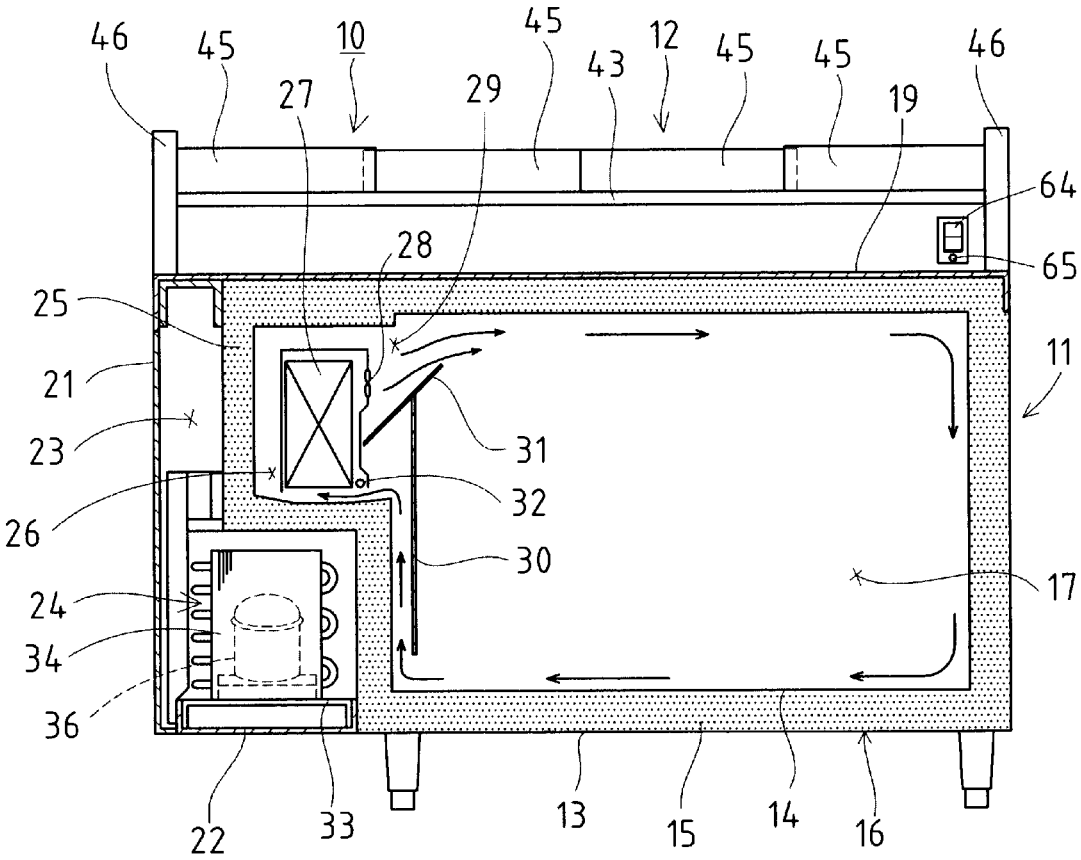
FIG. 3 is a vertical front sectional view of the horizontal refrigerator according to the embodiment.

Next, a horizontal refrigerator according to the present invention will be described below in connection with a preferred embodiment thereof with reference to the accompanying drawings. FIGS. 1 through 3 illustrate a horizontal refrigerator 10 according to an embodiment. The refrigerator 10 is basically comprised of a refrigerator body 11 positioned on the lower side, and a show-case 12 positioned on the upper side.

In the refrigerator body 11, a thermally insulated box 16 is comprised of an outer box 13; an inner box 14 disposed within the outer box 13, spaced therefrom by a given space; and an insulating material 15 such as urethane filled between both boxes 13, 14. A refrigerating chamber 17 is defined within the box 16 for containing cooled items such as food, beverages, and the like. The thermally insulated box 16 is formed in a front portion thereof with a rectangular opening 16*a* for use as an output port which opens in front. The opening 16*a* is opened and closed by a thermally insulated door 18. A top table 19 is arranged on the top surface of the outer box 13 in the thermally insulated box 16, so that the top table can be used as a cooking table.

In one side portion in the longitudinal direction in which the top table 19 extends in the thermally insulated box 16 (in a left side portion in FIG. 3), a machine chamber 23 is defined through a plurality of panels 20, 21 and a base 22, such that a refrigerating mechanism 24 (later described) is accommodated in the machine chamber 23. The top table 19, which defines an upper portion of the machine chamber 23 is provided with a cooler room 25 which extends downward from its lower surface to a level of approximately an intermediate position of the machine chamber 23. Within the cooler room 25, a cooler chamber 26 is defined in communication with the refrigerating chamber 17, while a cooler 27 and a built-in fan 28 of the cooling mechanism 24 are accommodated in the cooler chamber 26, such that cold air cooled by circularly supplying a coolant to the cooler 27 is forcedly circulated by convection into the refrigerating chamber 17 by the operation of the built-in fan 28 to cool down the refrigerating chamber 23.

A cold air diffuser 29 is formed through a left-hand wall of the thermally insulated box 16 opposing the machine chamber 23 at a position corresponding to the cooler chamber 26, so that cold air cooled by the cooler chamber 26 is blow into the refrigerator chamber 17 through the cold air diffuser 29 by the operation of the built-in fan 28. Also, a cold air suction duct 30 is provided on the left-hand wall of the thermally insulated box 16 below the cold air diffuser 29, such that air in the refrigerator 17 is sucked into the cooler chamber 26 through the duct 30. The cold air diffuser 29 is provided with a cold air guiding plate 31 for guiding the cold air upward to the refrigerating chamber 17. A first temperature sensor 32 is disposed near the cooler 27 for sensing the temperature in the refrigerating chamber 17, such that a refrigerating chamber electromagnetic valve 54 is controlled to open and close based on a temperature sensed by the sensor 32.

On a base plate 23 accommodated in the machine chamber 23 and arranged for withdrawal and retraction from the front side, components such as a condenser 34, a condenser fan 35 (see FIG. 4), and compressor 36, constituting the refrigerating mechanism 24, are attached in this order from the front side. A front panel 20 for defining the machine chamber 23 is formed therethrough with a large number of external air sucking ports 20*a*, while a side panel 21 is formed therethrough with a large number of blowing ports (not shown), such that the condenser 34 is air-cooled by air sucked from the outside by the operation of the condenser fan 35.

The show-case 12 installed on the rear side on the top surface of the thermally insulated box 16 is comprised of an outer box 37; an inner box 38 disposed within the outer box 37 and spaced therefrom by a given space; and a heat insulating material 39 such as urethane filled between both boxes 37, 38, with an opening 12*a* provided only in an upper portion to function as an output port, as illustrated in FIG. 1. Specifically, either of the outer box 37 and inner box 38 is formed in the shape of box which opens upward from the bottom surface, front surface, rear surface and both side surfaces. The upper opening of the inner box 38 accommodated in the outer box 37 serves as the opening 12*a*, and a storage chamber 40 is defined within the inner box 38 for storing food materials and the like. Also, the bottom surface of the inner box 38 is inclined downward from the rear edge to the front edge, such that a container 41 such as a tray, which contains food materials such as sushi materials, is carried through a drainboard 42 in a forwardly inclined state.

Rail members 43, 44 are provided between front and rear upper edges of the outer box 37 and inner box 38 over the whole length thereof in the longitudinal direction (in the left-to-right direction in FIG. 3), and a plurality of slidable doors (doors) 45 formed of a transparent material such as glass or resin substantially in an inverted C-shape in cross-section are removably and longitudinally slidably arranged between both rail members 43, 44. As illustrated in FIG. 1, the rear rail member 44 is positioned higher than the front rail member 43 by a predetermined dimension, such that the slidable doors 45 carried between both rail members 43, 44 are set to have their flat surfaces inclined in front. In this manner, food materials and the like stored in the storage chamber 40 can be readily viewed from the front side of the horizontal refrigerator 10 through the slidable doors 45. In FIG. 2, reference numeral 46 designates side covers which are disposed on both ends of the outer box 37 in the longitudinal direction.

As illustrated in FIG. 1, a cooling pipe 47 connected to the refrigerating mechanism 24 is disposed in a meander form in contact with the outer surface on the insulating material side in the bottom and rear portions of the inner box 38, such that the entire inner box 38 is cooled by circulation of a coolant supplied from the refrigerating mechanism 24. In other words, the storage chamber 40 is cooled by natural convection of cold air cooled by the inner box 38. The inner box 38 is formed of a material exhibiting a good thermal conductivity, and constructed to enable efficient cooling of the storage chamber 40.

A second temperature sensor 48 is disposed on an outer surface of the inner box 38 for sensing the temperature of the storage chamber 40, such that a storage chamber electromagnetic valve 56, later described, is controlled to open and close based on a temperature sensed by the sensor 48. In this event, while the inner box 38 itself is formed of the material exhibiting a good thermal conductivity, as mentioned above, the second temperature sensor 48 does not directly sense the temperature within the storage chamber 40, so that a difference is found between the temperature within the storage chamber 40 and the temperature sensed by the second temperature sensor 48. It is therefore recommended to correct this temperature difference by electronic control. Alternatively, the second temperature sensor 48 may be disposed within the storage chamber 40 to directly sense the internal temperature to control opening and closing of the storage chamber electromagnetic valve 56.

Figure 4:
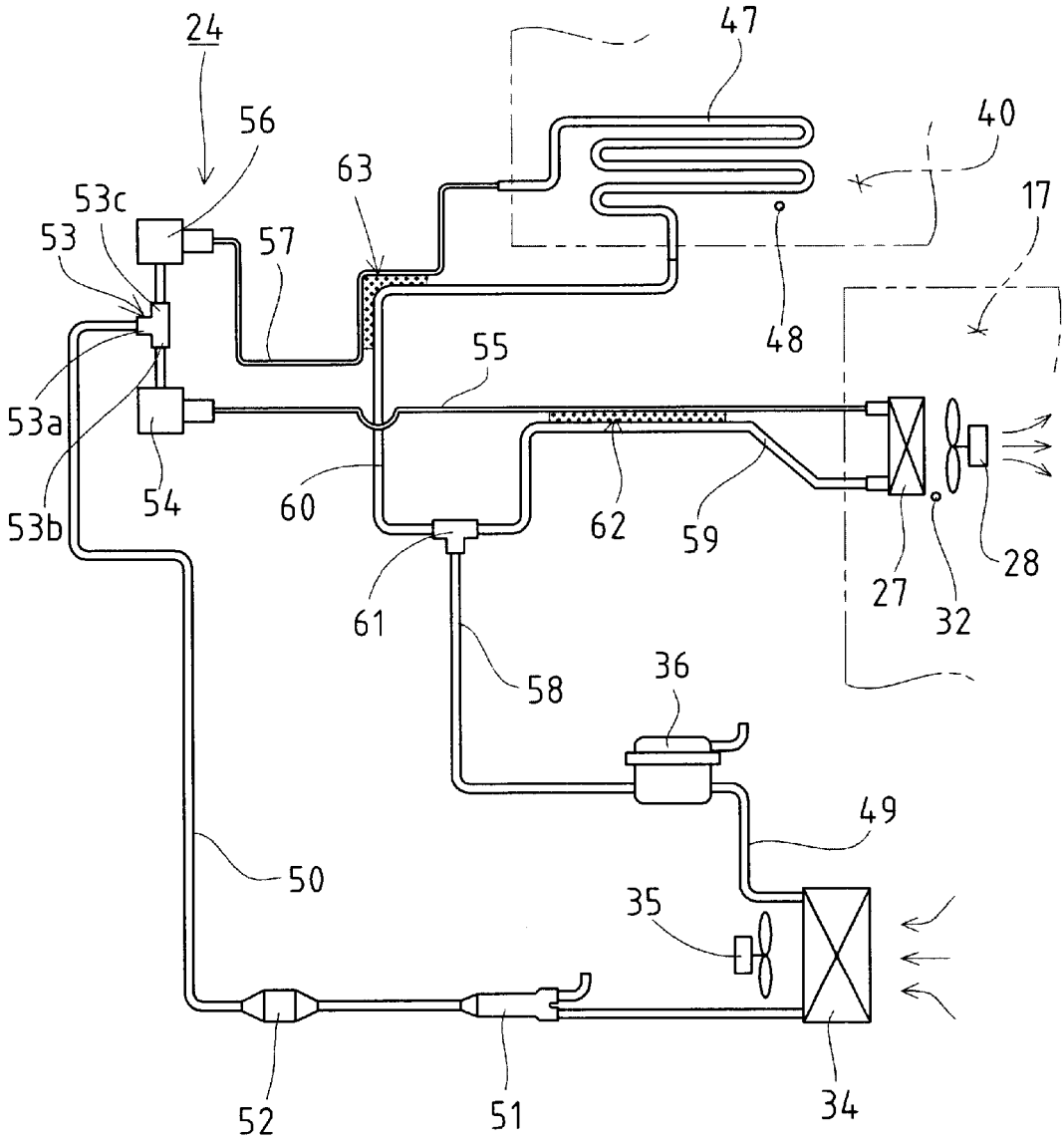
FIG. 4 is a general schematic view illustrating a refrigerating mechanism of the horizontal refrigerator according to the embodiment.

FIG. 4 illustrates the general structure of the refrigerating mechanism 24 in the horizontal refrigerator 10 according to the embodiment. In the refrigerating mechanism 24, a discharge pipe 49 routed out of the coolant discharge side of the compressor 36 is connected to a coolant inlet side of the condenser 34, so that high pressure and high temperature evaporated coolant compressed by the compressor 36 is supplied to the condenser 34 for condensation. A coolant pipe 50 routed out of a coolant outlet side of the condenser 34 is connected to a first connection port 53*a* of a first cheese 53 through a drier 51 and a strainer 52. A first capillary tube 55 is connected to a second connection port 53*b* of the first cheese 53 through the refrigerating chamber electromagnetic valve 54, and the first capillary tube 55 is connected to a coolant inlet side of the cooler 27. Also, a second capillary tube 57 is connected to a third connection port 53*c* of the first cheese 53 through the storage chamber electromagnetic valve (switching means) 56, and the second capillary tube 57 is connected to a coolant inlet side of the cooling pipe 47. Specifically, a portion of a liquefied coolant condensed by the condenser 34 is partially supplied to the cooler 27 through the first capillary tube 55, and the liquefied coolant decompressed through the first capillary tube 55 is inflated and evaporated in the cooler 27 to make heat exchange, such that cold air cooled by the cooler 27 cools down the refrigerating chamber 17. Also, a portion of the liquefied coolant condensed by the condenser 34 is partially supplied to the cooling pipe 47 through the second capillary tube 57. The liquefied coolant decompressed through the second capillary tube 57 is inflated and evaporated in the cooling pipe 47 to make heat exchange, such that the storage chamber 40 is cooled down through the inner box 38 which is cooled down by the cooling pipe 47.

An intake pipe 58 is connected to a coolant intake side of the compressor 36. A first feedback pipe 59 routed out of a coolant outlet side of the cooler 27, and a second feedback pipe 60 routed out of a coolant outlet side of the cooling pipe 47 are connected to the intake pipe 58 through a second cheese 61. The evaporated coolant heated through the heat exchange with the cooler 27 and cooling pipe 47 is fed back to the compressor 36 through the first feedback pipe 59, second feedback pie 60 and intake pipe 58 corresponding thereto. Then, the coolant fed back to the compressor 36 is again circulated after compressed at a high pressure and high temperature.

As illustrated in FIG. 4, in the refrigerating mechanism 24, a portion of the capillary tube 55 is connected by soldering or the like adjacent to and in parallel with the first feedback pipe 59 to provide a first heat exchanger 62. In this exchanger 62, the liquefied coolant distributed through the first capillary tube 55 is heat exchanged with the evaporated coolant distributed through the first feedback pipe 59 routed out of the cooler 27 to overcool the liquefied coolant. Also, a portion of the second capillary tube 57 is connected by soldering or the like adjacent to and in parallel with the second feedback pipe 60 to provide a second heat exchanger 63. In this exchanger 63, the liquefied coolant distributed through the second capillary tube 57 is heat exchanged with the evaporated coolant distributed through the second feedback pipe 60 routed out of the cooling pipe 47 to overcool the liquefied coolant.

On the front surface of the show-case 12, as illustrated in FIGS. 2 and 3, a power supply switch 64 is disposed as a shut-off means for blocking the storage chamber electromagnetic valve 56 from a power supply to stop cooling the storage chamber 40 by the cooling pipe 47. Specifically, the power supply switch is turned ON to connect the storage chamber electromagnetic valve 56 with the power supply. In this state, the electromagnetic valve 56 is controlled to open and close based on a temperature sensed by the second temperature sensor 48. Also, by turning the power supply switch 64 OFF, the storage chamber electromagnetic valve 56 is blocked from the power supply. In this state, the electromagnetic valve 56 is maintained in a closed state to stop supplying the coolant to the cooling pipe 47. Even if the power supply switch 64 is turned OFF, the refrigerating chamber 17 is continuously cooled by the cooler 27. In FIGS. 2 and 3, reference numeral 65 designates an operation lamp for displaying the ON state of the power supply switch 64.

Operation of Embodiment

Next, the operation of the horizontal refrigerator according to the embodiment will be described below. Assume that the power supply switch 64 is turned ON, so that the storage chamber 40 of the show-case 12 can be cooled down.

In the refrigerating mechanism 24 of the horizontal refrigerator 10, an evaporated coolant compressed by the compressor 36 is air cooled and condensed by the condenser 34 through the discharge pipe 49, and partially supplied to the first capillary tube 55 and second capillary tube 57 through the first cheese 53 to which the cooling pipe 50 is connected. Then, a liquefied coolant distributed through the first capillary tube 55 is heat exchanged and overcooled with the evaporated coolant distributed through the first feedback pipe 59 of the cooler 27 in the first heat exchanger 62. Then, the liquefied coolant inflates at a stroke in the cooler 27 and evaporates, whereby the coolant heat exchanges with air in the cooler chamber 26 in contact with the cooler 27, and cools down.

The cold air cooled by the cooler 27 is blown out of the cold air diffuser 29 to the refrigerating chamber 17 by the operation of the built-in fan 28. This cold air is circulated in the refrigerating chamber 17 to cool down the refrigerating chamber 17 (see FIG. 3). Then, the cold air heat-exchanged in the refrigerating chamber 17 is sucked into the cooler chamber 26 through the cold air suction duct 30, heat-exchanged again with the cooler 27 to be cooled down, and then blown out gain to the refrigerating chamber 17. In other words, in the refrigerator body 11 of the horizontal refrigerator 10, the refrigerating chamber 17 is efficiently cooled down by a cold air forced convection method.

Also, the liquefied coolant distributed through the second capillary tube 57 is heat-exchanged with the second feedback pipe 60 of the cooling pipe 47 in the second heat exchanger 63 to be overcooled, and inflates at a stroke within the cooling pipe 47 and evaporates, thereby heat exchanging with the inner box 38 for cooling down. Since the inner box 38 is formed of a material which exhibits a good thermal conductivity, the bottom, front, rear, and both side surfaces of the inner box 38 are efficiently cooled down so that air in contact with the inner box 38 is cooled down within the storage chamber 40, and the storage chamber 40 is cooled down by the resulting cold air which naturally circulates by convection. In other words, in the show-case 12, the storage chamber 40 is cooled down in a natural convection direction of the cold air, so that food materials and the like stored in the storage chamber 40 are not likely to get dry by the flow of cold air.

The coolant fed back to the compressor 36 through the first feedback pipe 59, second feedback pipe 60 and intake pipe 58 is recirculated after compressed at a high pressure and high temperature. In such a cooling operation, the refrigerating chamber electromagnetic valve 54 is controlled to open and close by the temperature in the refrigerating chamber 17 sensed by the first temperature sensor 32 to repeatedly supply and stop the coolant to the cooler 27, so that the refrigerating chamber 17 is maintained at a preset temperature. Likewise, in the show-case 12, the storage chamber electromagnetic valve 56 is controlled to open and close by the temperature in the storage chamber 40 sensed by the second temperature sensor 48 to repeatedly supply and stop the coolant to the cooling pipe 47, so that the storage chamber 40 is maintained at a preset temperature.

The opening 12*a* through which food materials and the like are put into and taken out of the storage chamber 40 is formed only in the top of the show-case 12, as described above, so that even if the slidable doors 45 are slid to open the opening 12*a*, heavy cold air cooled in the storage chamber 40 hardly flows out through the opening 12*a* of the top to the outside. Also, since the cold air does not flow out of the storage chamber 40, light and humid hot air outside the storage chamber 40 will hardly flow into the storage chamber 40. As a result, the temperature in the storage chamber 40 hardly changes, so that food materials can be prevented from deteriorating, and therefore maintain the freshness. In addition, since the inner box 38 has the bottom, front, rear and both side surfaces entirely covered with the heat insulating material 39, and the inner box 38 is formed of a material which exhibits a good thermal conductivity, the show-case 12 provides good heat insulating performance, and uniformly and efficiently cools down the entire inner box 38, thereby making it possible to prevent uneven temperatures from occurring in the storage chamber 40.

Here, for example, in a rotary sushi restaurant, the slidable doors 45 of the show-case 12 are highly frequently opened and closed, and particularly for busy hours, the show-case 12 is often used with the opening 12*a* left opened. Since the show-case 12 of the embodiment is constructed such that the slidable doors 45 can be removed, efforts of sliding the slidable doors 45 each time it is required can be eliminated by previously removing the slidable doors 45. Also, when the opening 12*a* is left fully opened, the operability is improved as well in transferring food materials and the like from the refrigerator body 11 to the show-case 12. Moreover, since the opening 12*a* is formed only in the top, a loss of cold air can be minimized even though the opening 12*a* is fully opened, thereby making it possible to maintain the freshness of the food materials and the like.

Also, since the show-case 12 is not in communication with the thermally insulated box 16 of the refrigerator body 11, air within the storage chamber 40 and warm air possibly introducing into the show-case 12 by leaving the opening 12*a* opened will not come into contact with the cooler 27 for cooling the refrigerating chamber 17 of the thermally insulated box 16, thereby preventing the refrigerating capability from being degraded due to much front attached thereto for a short time. Further, when the show-case 12 is separated from the refrigerator body 11 to use the body 11 alone, the ceiling of the thermally insulated box 16 is not formed with an opening for cold air, thereby avoiding degraded heat insulating performance and a reduced strength of the ceiling. In other words, cooking can be performed on the top plate 19 without hindrance, i.e., a degradation in the cooling capability of the refrigerating chamber 17 in the refrigerator body 11, or deformation, subduction and the like in cooking on the top plate 19.

Next, after service hours, food materials and the like within the storage chamber 40 in the show-case 12 are transferred to the refrigerating chamber 17. If the show-case 12 is no longer used, the power supply switch 64 is turned OFF. In this manner, the storage chamber electromagnetic valve 56 is blocked from the power supply, so that the electromagnetic valve 56 is maintained in a closed state in which the coolant is not supplied to the cooling pipe 47. Specifically, all the coolant supplied from the condenser 34 to the first cheese 53 is supplied to the cooler 27 through the first capillary tube 55 to achieve efficient cooling of the refrigerating chamber 17. Moreover, since the refrigerator body 11 is completely thermally insulated from the show-case 12, a load on the compressor can be reduced, thereby increasing the lifetime of the compressor 36, and reducing the power consumption to limit the running cost to a low value.

Also, for cleaning storage chamber 40 of the show-case 12, the storage chamber 40 can be defrosted before cleaning by turning the power supply switch 64 OFF while the refrigerating chamber 17 is continuously cooled, thereby providing high cleaning convenience.

While the show-case in the embodiment has the opening configured to be opened and closed by the slidable doors, the show-case may employ a construction in which the doors are pivotably arranged on the upper edge of the opening through a hinge or the like to open and close the opening by pivotal movement of the doors. Also, the power supply switch as the shutoff means may be mounted at any other location such as a control panel for entirely controlling the horizontal refrigerator, not limited to the show-case. The shut-off means employed herein may be such one that stops supplying the coolant to the cooling pipe by switching a switching means such as a switching valve which may be disposed in a coolant circuit system in the refrigerating mechanism.

What is claimed is:

1. A horizontal refrigerator for cooling a refrigerating chamber defined inside a thermally insulated box by a cooler of a cooling mechanism, and having a show-case disposed on a top surface of said heat insulating box, characterized in that:

said show-case comprises an outer box, an inner box disposed within said outer box spaced by a necessary space therefrom and a heat insulating material filled between both boxes, an opening is formed only in a top portion thereof, and a cooling pipe connected to said cooling mechanism is disposed in contact with an outer surface, where said beat insulating material is filled, of said inner box, such that a storage chamber defined inside said show-case is cooled by said cooling pipe, and further comprising a shut-off means for stopping cooling of said storage chamber by said cooling pipe while said refrigerating chamber is continuously cooled by said cooler.

2. The refrigerator with a show-case according to claim 1, wherein a lid is removably attached to said opening of said show-case for opening and closing said opening.

* * * * *